US006145259A

United States Patent [19]

Koenig, Jr. et al.

[11] Patent Number: 6,145,259

[45] Date of Patent: Nov. 14, 2000

[54] DRYWALL-TRIMMING ASSEMBLY RESISTING BUTT-EDGE SEPARATION

[75] Inventors: Joseph M. Koenig, Jr., Lincolnwood; Mark Budzik, Niles, both of Ill.

[73] Assignee: Trim-Tex, Inc., Lincolnwood, Ill.

[21] Appl. No.: 09/390,511

[22] Filed: Sep. 3, 1999

Related U.S. Application Data

[63] Continuation-in-part of application No. 29/093,817, Sep. 18, 1998.

[51] Int. Cl.[7] ..... E04B 2/00

[52] U.S. Cl. ..... 52/287.1; 52/255; 52/417

[58] Field of Search ..... 52/255, 257, 287.1, 52/288.1, 417, 726.1; 403/267, 294, 402

[56] References Cited

U.S. PATENT DOCUMENTS

| | | | |
|---|---|---|---|
| Re. 34,547 | 2/1994 | Weldy et al. . | |
| 3,325,585 | 6/1967 | Brenneman | 52/287.1 X |
| 4,115,970 | 9/1978 | Weinar | 52/311 |
| 4,363,839 | 12/1982 | Watanabe et al. | 52/717 X |
| 4,548,843 | 10/1985 | Kozuka et al. | 52/716 X |
| 4,863,774 | 9/1989 | Tucker | 52/417 X |
| 5,243,797 | 9/1993 | Koenig, Jr. | 52/254 |
| 5,505,032 | 4/1996 | Wasserman et al. | 52/287.1 |
| 5,615,530 | 4/1997 | Kartler | 52/287.1 X |
| 5,644,892 | 7/1997 | Smythe, Jr. | 52/287.1 X |
| 5,647,182 | 7/1997 | Rutherford | 52/255 X |
| 5,740,642 | 4/1998 | Koenig et al. . | |
| 5,752,353 | 5/1998 | Koenig et al. | 52/255 |
| 5,813,179 | 9/1998 | Koenig et al. . | |
| 5,904,016 | 5/1999 | Koenig et al. | 52/255 |
| 5,924,259 | 7/1999 | Marousek | 52/287.1 X |
| 6,052,956 | 4/2000 | Hoy et al. | 52/200 |

OTHER PUBLICATIONS

Trim–Tex, Inc. *1996–1997 Trim–Tex Catalog*—see Stock No. 0911 on p. 21; Stock No. 0912 on p. 21; Stock No. 0914 on p. 24; Stock No. 0913 on p. 24; Stock No. 0916 on p. 24; Stock No. 0915 on p. 25.

Macco Adhesives, Material Safety Data Sheet for Liquid Nails adhesive, undated—admitted prior art.

*Primary Examiner*—Bruce A. Lev

*Attorney, Agent, or Firm*—Rockey, Milnamow & Katz, Inc.

[57] ABSTRACT

A drywall-trimming assembly comprises a drywall edge-trimming strip extruded from polyvinyl chloride and a drywall corner-trimming device molded from acrylonitrile-butadiene-styrene. The drywall corner-trimming device has a projecting tab, which fits under an end portion of the drywall edge-trimming strip so that an outer surface of the projecting tab faces an inner surface of the end portion of the drywall edge-trimming strip. The projecting tab has a pattern of alternating ridges and grooves, which extend between the lateral edges of the projecting tab. An adhesive of a type that adheres comparatively less strongly to a unit of surface area of the outer surface of the projecting tab and that adheres comparatively more strongly to a unit of surface area of the inner surface of the end portion of the drywall edge-trimming strip is used for adhering the outer surface of the projecting tab to the inner surface of the end portion of the drywall edge-trimming strip. The inner surface of the end portion of the drywall edge-trimming strip is smooth on a macroscopic scale while the outer surface of the projecting tab has surface features causing the projecting tab to have a surface area that significantly exceeds the surface area that the outer surface of the projecting tab would have if smooth on a macroscopic scale.

37 Claims, 2 Drawing Sheets

FIG. 1
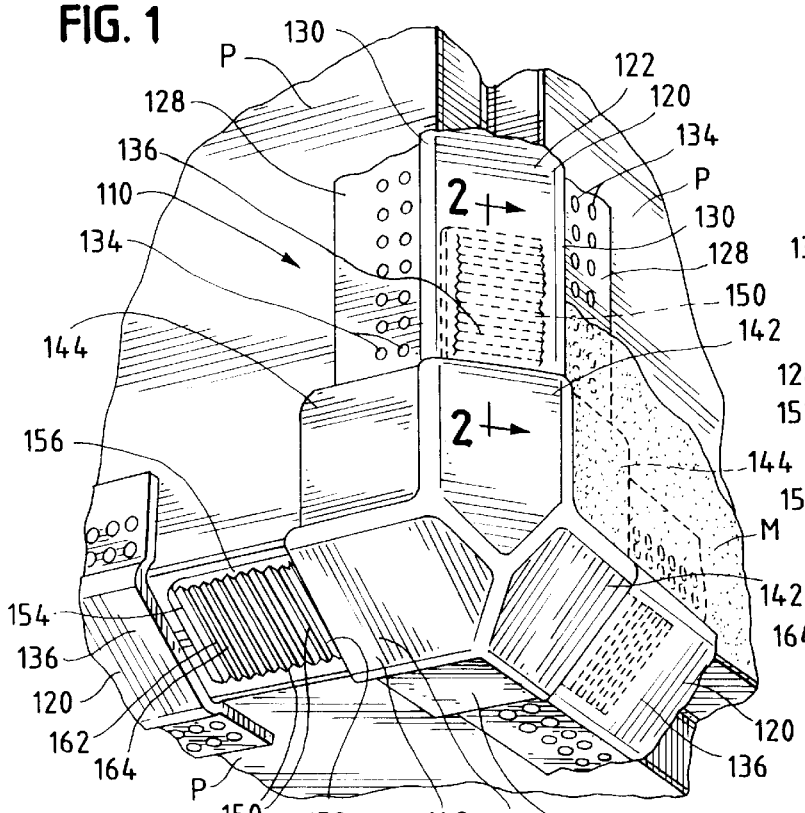
FIG. 2
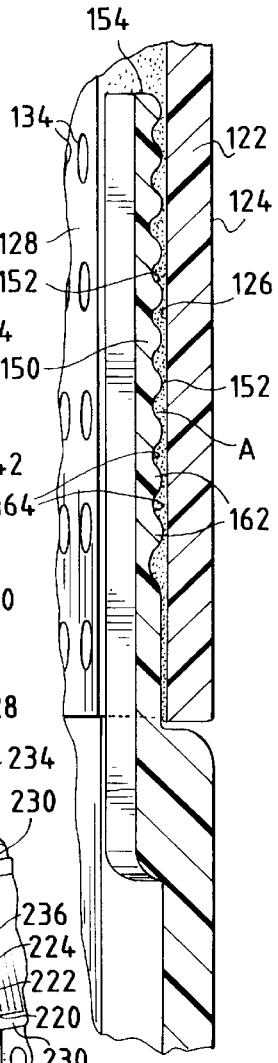
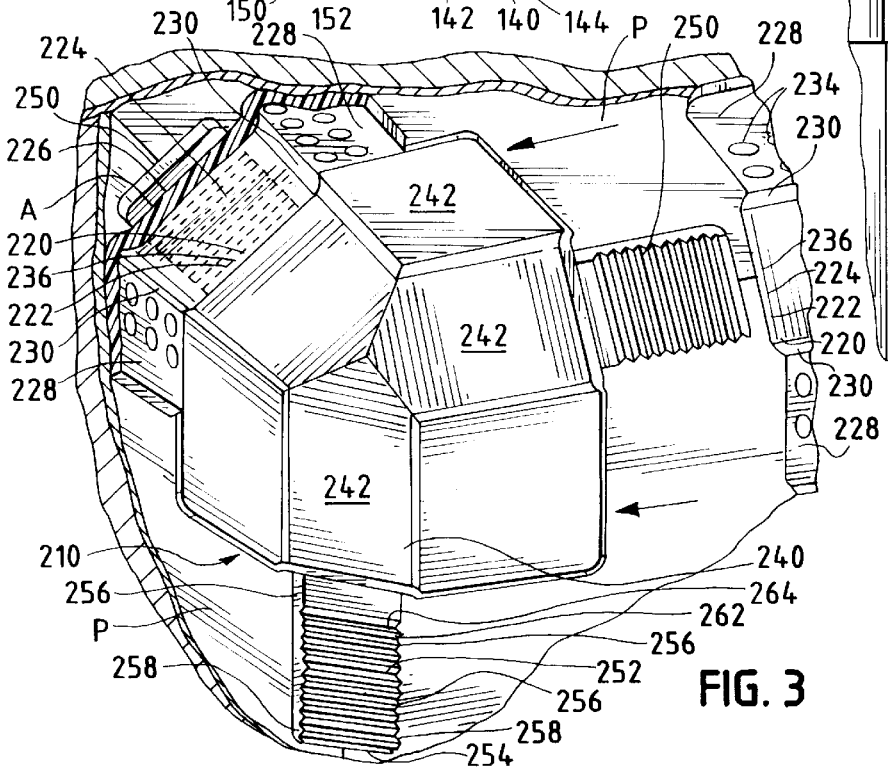
FIG. 3

DRYWALL-TRIMMING ASSEMBLY RESISTING BUTT-EDGE SEPARATION

CROSS-REFERENCE TO RELATED APPLICATION

This application is a continuation-in-part of U.S. Design Pat. application Ser. No. 29/093,817, which was filed on Sep. 18, 1998, and the disclosure of which is incorporated herein by reference.

TECHNICAL FIELD OF THE INVENTION

This invention pertains to improvements in a drywall-trimming assembly comprising a drywall edge-trimming strip and a drywall corner-trimming device, either an outside corner or an inside corner, which has a projecting tab adapted to fit under and to be adhesively secured to an end portion of the drywall edge-trimming strip.

BACKGROUND OF THE INVENTION

In residential and commercial construction, it is common to employ a drywall edge-trimming strip (corner bead) to trim a corner where two drywall panels approximate each other at a right angle or at an obtuse angle. Commonly, such a trimming is made from a suitable polymer, such as polyvinyl chloride. Commonly, such a trimming strip has a central portion having two lateral edges and two flanged portions, each of which extends from one of the lateral edges of the central portion.

If the drywall edge-trimming strip has a bullnose profile, each of the inner and outer surfaces of the central portion of the drywall edge-trimming strip has an arcuate profile. If the drywall edge-trimming strip has a mitered profile, each of the inner and outer surfaces of the central portion of the drywall edge-trimming strip is planar. Such drywall edge-trimming strips, which are extruded from polyvinyl chloride, are available commercially from Trim-Tex, Inc. of Lincolnwood, Ill., under its TRIM-TEX trademark.

Commonly, such drywall edge-trimming strips are assembled with two-legged (two-way) drywall corner-trimming devices and with three-legged (three-way) drywall corner-trimming devices, as exemplified in U.S. Pat. No. Re. 34,547, in U.S. Pat. No. 5,138,810, and, in a novel design, in U.S. Design Pat. application Ser. No. 29/093,817, supra. As exemplified in U.S. Pat. No. Re. 34,547, it is known for each leg of such a corner to have a projecting tab (tongue) which is adapted to fit under an end portion of a drywall edge-trimming strip. Such drywall corner-trimming devices, which are molded from acrylonitrile-butadiene-styrene, are available commercially from Trim-Tex, Inc. of Lincolnwood, Ill., under its TRIM-TEX trademark.

A problem that can occur with such a strip and with such a corner is "butt-edge separation", which refers to separation that can occur at the ends where two such strips approximate each other or where such a strip and one leg of such a corner approximate each other, and which can lead to unsightly conditions, such as cracked paint. In U.S. Pat. No. 5,740,642 and U.S. Pat. No. 5,813,179, the disclosures of which are incorporated herein by reference, the problem of butt-edge separation is addressed by splices. As disclosed in U.S. Pat. No. 5,740,642, a splice is stressed so as to be mechanically secured, although the splice also may be adhesively secured. As disclosed in U.S. Pat. No. 5,813,179, a splice is perforated so as to ventilate an adhesive layer securing the splice. As also disclosed in U.S. Pat. No. 5,813,179, suitable adhesives include construction adhesives of a type exemplified by MIRACLE DSA-20 adhesive available commercially from Miracle Adhesives Corporation of Newark, N.J., and by LIQUID NAILS adhesive available commercially from Macco Adhesives of Cleveland, Ohio.

If a drywall edge-trimming strip extruded from polyvinyl chloride is assembled with a drywall corner-trimming device molded from acrylonitrile-butadiene-styrene, and if an adhesive of the type discussed in the preceding paragraph or an adhesive of a type known as a "mirror mastic" and available commercially from various sources is used to secure the projecting tab (tongue) of the drywall corner-trimming device to and under one end portion of the drywall edge-trimming strip, the adhesive tends to adhere comparatively more strongly to a unit of surface area of the inner surface of the end portion of the drywall corner-trimming device and to adhere comparatively less strongly to a unit of surface area of the outer surface of the projecting tab (tongue) of the drywall corner-trimming device. Apparently, it is characteristic of such adhesives to adhere comparatively less strongly to a styrene polymer, such as acrylonitrile-butadiene-styrene, and to adhere comparatively more strongly to polyvinyl chloride.

SUMMARY OF THE INVENTION

This invention provides a drywall-trimming assembly comprising a drywall edge-trimming strip extruded from a first polymer, preferably from polyvinyl chloride, and a drywall corner-trimming device molded from a second polymer, preferably from a styrene polymer and more preferably from acrylonitrile-butadiene-styrene. The drywall corner-trimming device has a projecting tab adapted to fit under an end portion of the drywall edge-trimming strip so that an outer surface of the projecting tab faces an inner surface of the end portion of the drywall edge-trimming strip. Herein, the term "inner" and the term "outer" are taken from a vantage of a person viewing the drywall-trimming assembly, as installed.

An adhesive of a type that adheres comparatively less strongly to a unit of surface area of the outer surface of the projecting tab and that adheres comparatively more strongly to a unit of surface area of the inner surface of the end portion of the drywall edge-trimming strip constitutes means for adhering the outer surface of the projecting tab to the inner surface of the end portion of the drywall edge-trimming strip. If the drywall edge-trimming strip is extruded from polyvinyl chloride and if the drywall corner-trimming device is molded from a styrene polymer, such as acrylonitrile-butadiene-styrene, one of the construction adhesives discussed above may be thus used.

This invention contemplates that the inner surface of the end portion of the drywall edge-trimming strip is smooth while the outer surface of the projecting tab has surface features causing the outer surface of the projecting tab to have a surface area that significantly exceed the surface area that the outer surface of the projecting tab would have if smooth. Preferably, the surface features comprise alternating ridges and grooves. Preferably, moreover, the projecting tab has a distal edge and two side edges and the alternating ridges and grooves extend between the side edges. Herein, the term "smooth" is taken on a macroscopic scale.

This invention is useful whether the drywall corner-trimming device is an outside corner or an inside corner. This invention is useful whether the inner surface of the end portion of the drywall edge-trimming strip conforms approximately to a sector of a circular cylinder where the projecting tab is adapted to fit thereunder, as in a drywall edge-trimming strip having a bullnose profile, or approximately to a plane where the projecting tab is adapted to fit thereunder, as in a drywall edge-trimming strip having a mitered profile.

This invention also provides a drywall corner-trimming device, which is molded from a polymeric material and which has a projecting tab having an outer surface. Being adapted to fit under an inner surface of an end portion of a drywall edge-trimming strip, the projecting tab has surface features causing its outer surface to have a surface area that significantly exceeds the surface area that the same surface would have if smooth.

In the drywall-trimming assembly provided by this invention, the drywall corner-trimming device may have two similar tabs, if a two-legged (two way) corner, or three similar tabs, if a three-legged (three way) corner, each such tab having similar features and coacting similarly with a drywall edge-trimming strip. Similarly, the drywall corner-trimming device provided by this invention may have two similar tabs, if a two-legged (two way) corner, or three similar tabs, if a three-legged (three way) corner.

Inherently, without regard to the materials used to make the drywall edge-trimming strip and the drywall corner-trimming device, surface features defining at least one inset, such as a groove, are adapted to retain at least some of the adhesive, much of which tends to be extruded when the outer surface of the projecting tab and the inner surface of the end portion of the drywall edge-trimming strip are pressed together.

These and other objects, features, and advantages of this invention are evident from the following description of several contemplated embodiments of this invention, with reference to the accompanying drawings.

BRIEF DESCRIPTION OF THE DRAWINGS

FIG. 1 is a fragmentary, perspective view of a drywall-trimming assembly comprising three similar drywall edge-trimming strips, each having a mitered profile, and a three-way, outside, drywall corner-trimming device.

FIG. 2 is a fragmentary, sectional view taken along line 2—2 in FIG. 1, in a direction indicated by arrows.

FIG. 3 is a fragmentary, perspective view of a drywall-trimming assembly comprising three similar drywall edge-trimming strips, each having a mitered profile, and a three-way, inside, drywall corner-trimming device.

DETAILED DESCRIPTION OF THE ILLUSTRATED EMBODIMENTS

Figure 4:
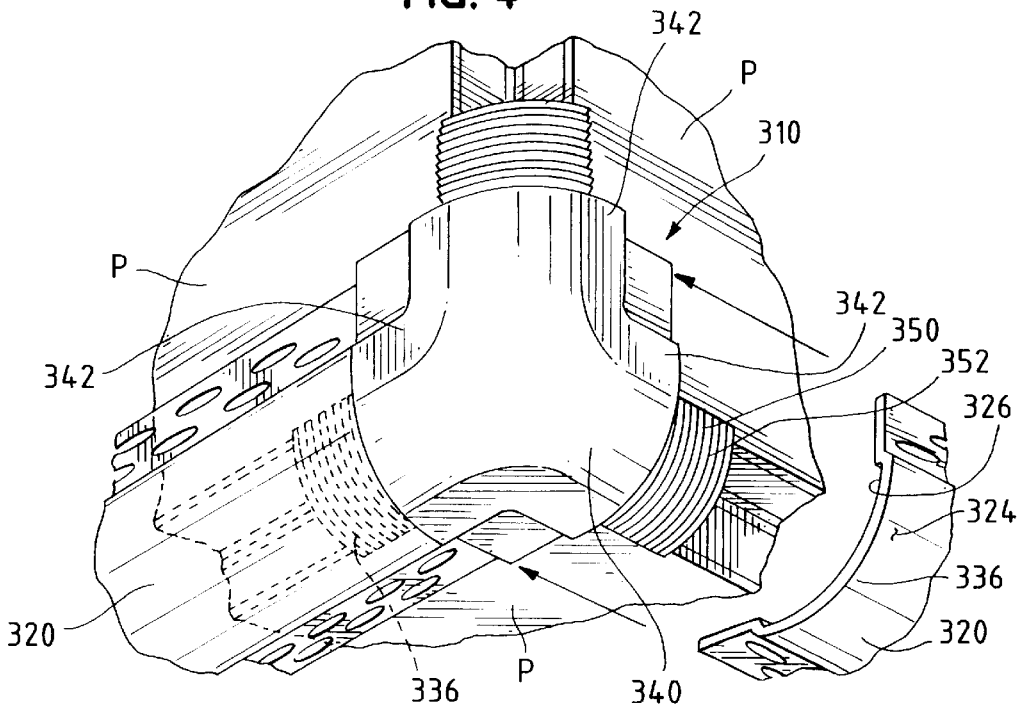
FIG. 4 is a partly exploded, fragmentary, perspective view of a drywall-trimming assembly comprising similar drywall edge-trimming strips, each having a bullnose profile, and a three-way, outside, drywall corner-trimming device.

As illustrated in FIGS. 1 and 2, in a first embodiment contemplated by this invention, a drywall-trimming assembly 110 is employed where three drywall panels P approximate one another at mutually orthogonal angles, at three edges defining an outside corner. The drywall-trimming assembly 110 comprises three drywall edge-trimming strips 120, each of which has a mitered profile suitable to trim an outside edge, and a three-legged (three way) corner 140, each leg of which has a complementary profile. A mitered profile may be also called a chamfered profile. As provided by this invention, the drywall edge-trimming strips 120 are secured adhesively to the drywall corner-trimming device 140 in a novel manner, which is described below, so as to resist butt-edge separation.

Each drywall edge-trimming strip 120 is extruded from polyvinyl chloride, which is known commonly as PVC, so as to have a central part 122, which has an outer surface 124 and a planar, inner surface 126, and so as to have two lateral flanges 128, each of which extends laterally and inwardly at an angle of approximately 45° from a step 130 extending along one of two opposite edges 132 of the central part 122. Each of the lateral flanges 128 is punched so as to have a multiplicity of holes 134, as shown, or slots. One end portion 136 of each drywall edge-trimming strip 120 is shown.

Except as illustrated and described herein, the drywall corner-trimming device 140 is similar to the three-way, mitered, drywall corner-trimming device disclosed in U.S. Design Pat. application Ser. No. 29/093,817, supra. The drywall corner-trimming device 140 is injection molded from acrylonitrile-butadiene-styrene, which is known commonly as ABS, so as to have three legs 142, each of which is intended to be adhesively secured to an associated one of the drywall edge-trimming strips 120, and so as to have three square webs 144, each of which is disposed between an adjacent two of the legs 142.

Each leg 142 of the drywall corner-trimming device 140 has a projecting tab 150, which may be also called a tongue, which has an outer surface 152 that is planar, except for surface features discussed below. The projecting tab 150 is adapted to fit under the end portion 134 of the associated one of the drywall edge-trimming strips 120 so that the outer surface 152 of the projecting tab 150 faces the inner surface 126 of the end portion 136 thereof. The projecting tab has a distal edge 154, two lateral edges 156, and two rounded corners 158.

As surface features causing the outer surface 152 of the projecting tab 150 to have a surface area that significantly (e.g. by nearly two times) exceeds the surface area that the outer surface 152 of the projecting tab 150 would have if smooth, the projecting tab 150 has a pattern of alternating ridges 162 and grooves 164. The ridges 162 and grooves 164 extend between the lateral edges 156 of the projecting tab 150.

An adhesive A of the type exemplified by MIRACLE DSA-20 adhesive available commercially from Miracle Adhesives Corporation of Newark, N.J., and by LIQUID NAILS adhesive available commercially from Macco Adhesives of Cleveland, Ohio, or an adhesive of the type known as a "mirror mastic" and available commercially from various sources is used for adhering the outer surfaces 152 of the projecting tab 150 to the inner surface 126 of the end portions 134 of the drywall edge-trimming strips 120.

By causing the outer surfaces 152 of each projecting tab 150 to have a surface area that significantly exceeds the surface area that the outer surface 152 of such projecting tab 150 would have if smooth, the ridges 162 and grooves 164 compensate for the adhesive A adhering comparatively less strongly to a unit of surface area of the outer surfaces 152 of the projecting tabs 150 of the drywall corner-trimming device 140, which is injection molded from acrylonitrile-butadiene-styrene, and comparatively more strongly to a unit of surface area of the inner surfaces 126 of the end portion 134 of the drywall edge-trimming strips 120, which are extruded from polyvinyl chloride.

Inherently, without regard to the materials used to make the drywall edge-trimming strips 120 and the drywall corner-trimming device 140, the grooves 164 are adapted, as insets, to retain at least some of the adhesive A, much of which tends to be extruded when the outer surfaces 152 of the projecting tabs 150 and the inner surfaces 126 of the end portions 136 of the drywall edge-trimming strips 120 are pressed together.

When the drywall edge-trimming strips 120 and the drywall corner-trimming device 140 are installed, the lateral flanges 128 of the drywall edge-trimming strips 120 are tacked to the underlying panels P, as by staples (not shown) or adhesively, and the drywall corner-trimming device 140 is secured adhesively to the drywall-trimming strips 120, by the adhesive A, before drywall-finishing material M is applied over the lateral flanges 128 of the drywall edge-trimming strips 120 and over the square webs 144 of the drywall corner-trimming device 140. When such material M is applied thereover, such material M is pressed through the holes 134, against the underlying panels P, so as to bond the drywall edge-trimming strips 120 and the drywall-corner-trimming device 140 to the underlying panels P. The adhesive A resists butt-edge separation between the drywall edge trimming strips 120 and the drywall corner-trimming device 140.

As illustrated in FIG. 3, in a second embodiment contemplated by this invention, a drywall-trimming assembly 210 is employed where three drywall panels P approximate one another at mutually orthogonal angles, at three edges defining an inside corner. The drywall-trimming assembly 210 comprises three drywall edge-trimming strips 220, each of which has a mitered profile suitable to trim an inside edge, and a three-legged (three way) corner 240, each leg 242 of which has a complementary profile. Except as illustrated and described, the second embodiment is similar to the first embodiment, supra, and is installed similarly.

Each drywall edge-trimming strip 220 is extruded from polyvinyl chloride, which is known commonly as PVC, so as to have a central part 222, which has an outer surface 224 and a planar, inner surface 226, and so as to have two lateral flanges 228, each of which extends laterally and inwardly at an angle of approximately 45° from a step 230 extending along one of two opposite edges 232 of the central part 222. Each of the lateral flanges 228 is punched so as to have a multiplicity of holes 234, as shown, or slots in a known manner. The end portions 236 of two drywall edge-trimming strip 220 are shown. One drywall edge-trimming strip is not shown.

The drywall corner-trimming device 240 is injection molded from acrylonitrile-butadiene-styrene so as to have three legs 242, each of which is intended to be adhesively secured to an associated one of the drywall edge-trimming strips 220, and so as to have three square webs 244, each of which is disposed between an adjacent two of the legs 242.

Each leg 242 of the drywall corner-trimming device 240 has a projecting tab 250, which has an outer surface 252 conforming approximately to the inner surface 226 of the associated one of the drywall edge-trimming strips, except for surface features described below. The projecting tab 250 is adapted to fit under the end portion 236 of the associated one of the drywall edge-trimming strips 220 so that the outer surface 252 of the projecting tab 250 faces the inner surface 226 of the end portion 236 thereof. The projecting tab has a distal edge 254, two lateral edges 256, and two rounded corners 258.

As surface features causing the outer surface 252 of the projecting tab 250 to have a surface area that significantly exceeds the surface area that the outer surface 252 of the projecting tab 250 would have if smooth, the projecting tab 250 has a pattern of alternating ridges 262 and grooves 264. The ridges 262 and grooves 264 extend between the lateral edges 256 of the projecting tab 250.

The adhesive A is used for adhering the outer surfaces 252 of the projecting tab 250 to the inner surface 226 of the end portions 134 of the drywall edge-trimming strips 220. The ridges 262 and grooves 264 compensate for the adhesive A adhering comparatively less strongly to a unit of surface area of the outer surfaces 252 of the projecting tabs 250 of the drywall corner-trimming device 240, which is injection molded from acrylonitrile-butadiene-styrene, and comparatively more strongly to a unit of surface area of the inner surfaces 226 of the end portion 234 of the drywall edge-trimming strips 220, which are extruded from polyvinyl chloride.

As illustrated in FIG. 4, in a third embodiment contemplated by this invention, a drywall-trimming assembly 310 is employed where three drywall panels P approximate one another at mutually orthogonal angles, at three outside edges defining an inside corner. The drywall-trimming assembly 310 comprises three drywall edge-trimming strips 320, each of which has a bullnose profile suitable to trim an outside edge, and a three-legged (three way) drywall corner-trimming device 340, each leg 342 of which has a complementary profile. The end portions 336 of two drywall edge-trimming strip 320 are shown. One drywall edge-trimming strip is not shown.

At its end portion 336, each drywall edge-trimming strip 320 has an outer surface 324 and a concave, inner surface, which conforms approximately to a sector of a circular cylinder. Each leg 342 of the drywall corner-trimming device 340 has a projecting tab 350, which has a convex, outer surface 352 conforming approximately to the inner surface 326 of the end portion 336 of an associated one of the drywall-edge trimming strips 320, except that the outer surface 352 has surface features, namely a pattern of alternating ridges 362 and grooves 364, which features cause the outer surface 352 to have a surface area that significantly exceeds the surface area that the outer surface 352 would have if smooth. An adhesive (not shown) like the adhesive A of the first and second embodiments is used to secure the outer surfaces 352 of the projecting tabs 350 to and under the inner surfaces 326 of the end portions 336 of the drywall-trimming strips 320. Except as illustrated and described, the third embodiment is similar to the first and second embodiments, supra, and is assembled similarly and is installed similarly.

Figure 5:
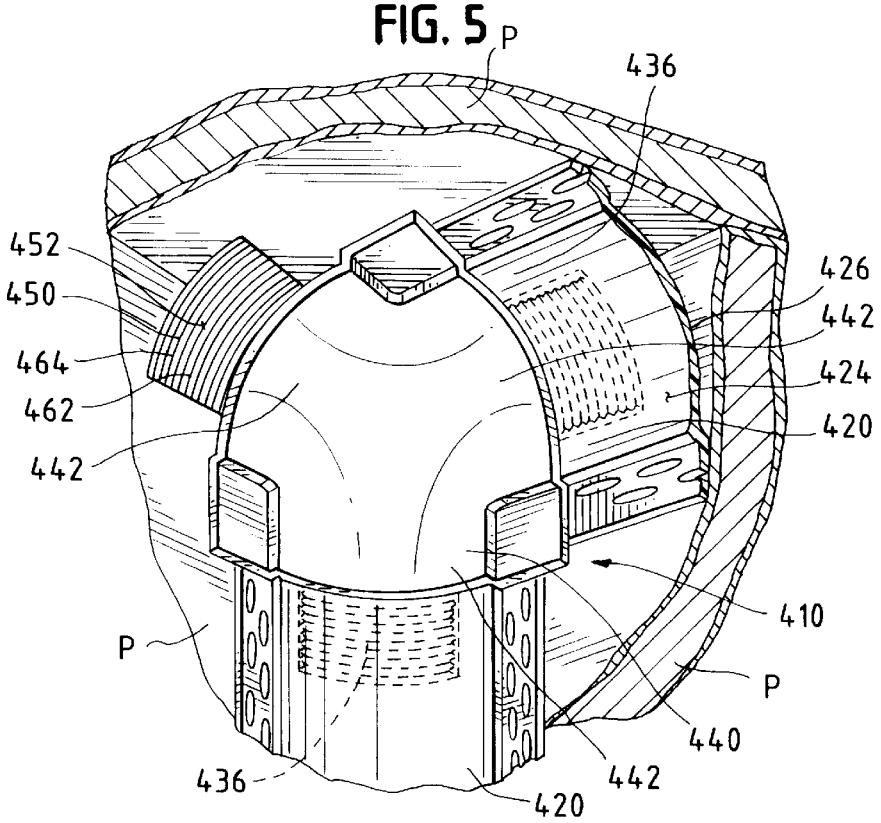
FIG. 5 is a partly exploded, fragmentary, perspective view of a drywall-trimming assembly comprising similar drywall edge-trimming strips, each having a bullnose profile, and a three-way, inside, drywall corner-trimming device.

As illustrated in FIG. 5, in a fourth embodiment contemplated by this invention, a drywall-trimming assembly 410 is employed where three drywall panels P approximate one another at mutually orthogonal angles, at three outside edges defining an inside corner. The drywall-trimming assembly 410 comprises three drywall edge-trimming strips 420, each of which has a bullnose profile suitable to trim an inside edge, and a three-legged (three way) drywall corner-trimming device 440, each leg 442 of which has a complementary profile. The end portions 436 of two drywall edge-trimming strip 420 are shown. One drywall edge-trimming strip is not shown.

At its end portion 436, each drywall edge-trimming strip 420 has an outer surface 424 and a convex, inner surface, which conforms approximately to a sector of a circular cylinder. Each leg 442 of the drywall corner-trimming device 440 has a projecting tab 450, which has a concave, outer surface 452 conforming approximately to the inner surface 426 of the end portion 436 of an associated one of the drywall-edge trimming strips 420, except that the outer surface 452 has surface features, namely a pattern of alternating ridges 462 and grooves 464, which features cause the outer surface 452 to have a surface area that significantly exceeds the surface area that the outer surface 452 would have if smooth. An adhesive (not shown) like the adhesive A of the first and second embodiments is used to secure the outer surfaces 452 of the projecting tabs 450 to and under the inner surfaces 426 of the end portions 436 of the drywall-trimming strips 420. Except as illustrated and described, the fourth embodiment is similar to the first, second, and third embodiments, supra, and is assembled similarly and is installed similarly.

Various modifications may be made in the illustrated embodiments, as described above, without departing from the scope and spirit of this invention.

What is claimed is:

1. A drywall-trimming assembly comprising a drywall edge-trimming strip extruded from a first polymer, a drywall corner-trimming device molded from a second polymer, the drywall corner-trimming device having a projecting tab adapted to fit under an end portion of the drywall edge-trimming strip so that an outer surface of the projecting tab faces an inner surface of the end portion of the drywall edge-trimming strip, and an adhesive of a type that adheres less strongly to a unit of surface area of the outer portion of the projecting tab and that adheres more strongly to a unit of surface area of the inner surface of the end portion of the drywall edge-trimming strip, the adhesive constituting means for adhering the outer surface of the projecting tab to the inner surface of the end portion of the drywall edge-trimming strip, wherein the inner surface of the end portion of the drywall edge-trimming strip is smooth on a macroscopic scale while the outer surface of the projecting tab has surface features causing the outer surface of the projecting tab to have a surface area that significantly exceeds the surface area that the outer surface of the projecting tab would have if smooth on a macroscopic scale.

2. The drywall-trimming assembly of claim 1 wherein the drywall corner-trimming device is an outside corner-trimming device.

3. The drywall-trimming assembly of claim 2 wherein the inner surface of the end portion of the drywall edge-trimming strip is cylindrical where the projecting tab is adapted to fit thereunder.

4. The drywall-trimming assembly of claim 3 wherein the surface features comprise alternating ridges and grooves.

5. The drywall-trimming assembly of claim 4 wherein the projecting tab has two lateral edges, between which the ridges and grooves extend.

6. The drywall-trimming assembly of claim 2 wherein the surface features comprise alternating ridges and grooves.

7. The drywall-trimming assembly of claim 6 wherein the projecting tab has two lateral edges, between which the ridges and grooves extend.

8. The drywall-trimming assembly of claim 2 wherein the inner surface of the end portion of the drywall edge-trimming strip is planar where the projecting tab is adapted to fit thereunder.

9. The drywall-trimming assembly of claim 8 wherein the surface features comprise alternating ridges and grooves.

10. The drywall-trimming assembly of claim 9 wherein the projecting tab has two lateral edges, between which the ridges and grooves extend.

11. The drywall-trimming assembly of claim 2 wherein the drywall corner-trimming device is an inside corner-trimming device.

12. The drywall-trimming assembly of claim 11 wherein the inner surface of the end portion of the drywall edge-trimming strip is planar where the projecting tab is adapted to fit thereunder.

13. The drywall-trimming assembly of claim 12 wherein the surface features comprise alternating ridges and grooves.

14. The drywall-trimming assembly of claim 13 wherein the projecting tab has two lateral edges, between which the alternating ridges and grooves extend.

15. The drywall-trimming assembly of claim 11 wherein the inner surface of the end portion of the drywall edge-trimming strip is cylindrical where the projecting tab is adapted to fit thereunder.

16. The drywall-trimming assembly of claim 15 wherein the surface features comprise alternating ridges and grooves.

17. The drywall-trimming assembly of claim 16 wherein the projecting tab has two lateral edges, between which the ridges and grooves extend.

18. The drywall-trimming assembly of claim 11 wherein the surface features comprise alternating ridges and grooves.

19. The drywall-trimming assembly of claim 18 wherein the projecting tab has two lateral edges, between which the ridges and groove extend.

20. The drywall-trimming assembly of claim 1 wherein the surface features comprise alternating ridges and grooves.

21. The drywall-trimming assembly of claim 20 wherein the projecting tab has two lateral edges, between which the alternating ridges and grooves extend.

22. The drywall-trimming assembly of any one of claims 1 through 17 wherein the first polymer is polyvinyl chloride and wherein the second polymer is a styrene polymer.

23. The drywall-trimming assembly of any one of claims 1 through 17 wherein the first polymer is polyvinyl chloride and wherein the second polymer is acrylonitrile-butadiene-styrene.

24. A drywall corner-trimming device molded from a polymeric material, the drywall corner-trimming device having a projecting tab, which is adapted to fit under an inner surface of an end portion of and which has surface features causing an outer surface of the projecting tab to have a surface area that significantly exceeds the surface area that the outer surface of the projecting tab would have if smooth on a macroscopic scale.

25. The drywall corner-trimming device of claim 24, which is an outside corner-trimming device.

26. The drywall corner-trimming device of claim 25 or 24 wherein the surface features comprise alternating ridges and grooves.

27. The drywall corner-trimming device of claim 25 or 26 wherein the projecting tab has two lateral edges, between which the ridges and grooves extend.

28. The drywall corner-trimming device of claim 24, which is an inside corner-trimming device.

29. A drywall-trimming assembly comprising a drywall edge-trimming strip, a drywall corner-trimming device having a projecting tab adapted to fit under an end portion of the drywall edge-trimming strip so that an outer surface of the projecting tab faces an inner surface of the end portion of the drywall edge-trimming strip, and an adhesive constituting means for adhering the outer surface of the projecting tab to the inner surface of the end portion of the drywall edge-trimming strip, wherein the outer surface of the projecting tab has surface features defining at least one inset region and causing the outer surface of the projecting tab to have a surface area that significantly exceeds the surface area that the outer surface of the projecting tab would have if smooth on a macroscopic scale.

30. The drywall-trimming assembly of claim 29 wherein the drywall corner-trimming device is an outside corner-trimming device.

31. The drywall-trimming assembly of claim 30 wherein the inner surface of the end portion of the drywall edge-trimming strip is planar where the projecting tab is adapted to fit thereunder.

32. The drywall-trimming assembly of claim 30 wherein the inner surface of the end portion of the drywall edge-trimming strip is cylindrical where the projecting tab is adapted to fit thereunder.

33. The drywall-trimming assembly of claim 29 wherein the drywall corner-trimming device is an insider corner-trimming device.

34. The drywall-trimming assembly of claim 33 wherein the inner surface of the end portion of the drywall edge-trimming strip is planar where the projecting tab is adapted to fit thereunder.

35. The drywall-trimming assembly of claim 33 wherein the inner surface of the end portion of the drywall edge-trimming strip is cylindrical where the projecting tab is adapted to fit thereunder.

36. The drywall-trimming assembly of any one of claims 29 through 35 wherein the surface features comprise alternating ridges and grooves.

37. The drywall-trimming assembly of claim 36 wherein the projecting tab has two lateral edges, between which the ridges and grooves extend.

* * * * *